United States Patent [19]

Pennell

[11] 4,015,851

[45] Apr. 5, 1977

[54] RUBBER GRIP FOR TENNIS RACKET HANDLES

[75] Inventor: Paul H. Pennell, North Jackson, Ohio

[73] Assignee: Elastomeric Products Inc., North Jackson, Ohio

[22] Filed: Feb. 9, 1976

[21] Appl. No.: 656,714

[52] U.S. Cl. ..... 273/75; 273/81.5

[51] Int. Cl.[2] ..... A63B 49/08

[58] Field of Search ..... 273/72 R, 73 J, 75, 273/81 R, 81.5, 81.6

[56] References Cited

UNITED STATES PATENTS

| | | | |
|---|---|---|---|
| 1,556,781 | 10/1925 | Gjorup | 273/81.6 |
| 1,940,104 | 12/1933 | Russell et al. | 273/81.5 |
| 2,200,626 | 5/1940 | Lamkin | 273/81.6 |
| 2,671,660 | 3/1954 | Goodwin | 273/81.6 |
| 2,671,661 | 3/1954 | Goodwin | 273/81.6 |

FOREIGN PATENTS OR APPLICATIONS

| | | | |
|---|---|---|---|
| 12,661 | 6/1904 | United Kingdom | 273/81.5 |
| 443,228 | 2/1936 | United Kingdom | 273/81.6 |

*Primary Examiner*—Richard J. Apley
*Attorney, Agent, or Firm*—Webster B. Harpman

[57] ABSTRACT

A rubber grip for a tennis racket handle has a double lamination of two rubber materials, the bottom layer being a relatively harder stronger material than the upper or outer layer and the upper layer being a soft tacky rather weak material that provides good adhesion when gripped by the hand. The bottom or inner layer is relatively thin as compared with the upper or outer layer and its characteristics permit the grip to be stretched and wrapped around the tennis racket handle without breaking or tearing.

1 Claim, 3 Drawing Figures

RUBBER GRIP FOR TENNIS RACKET HANDLES

BACKGROUND OF THE INVENTION

1. Field of the Invention

This invention relates to the handle coverings or handle grips for tennis rackets and the like.

2. Description of the Prior Art

Prior inventions of this type have comprised strips of leather, plastic materials or rubber which are arranged to be spirally wound around a handle of a tennis racket or the like (see U.S. Pats. Nos. 1,940,104, 2,046,164 3,311,375 and 3,606,326).

This invention provides a novel laminated handle grip, the inner and outer layers of which have distinctly different characteristics facilitating the installation of the grip and providing a surface which is easier to hold, longer wearing and has improved shock absorber and hand comfort qualities.

SUMMARY OF THE INVENTION

A rubber grip for tennis racket handles comprises an elongated, laminated appropriately shaped vulcanized molding of different rubber compounds, one of which, the inner layer is a harder stronger material that permits the grip to be stretched and wrapped around the tennis racket handle without fear of breaking or tearing while the upper or outer layer is a soft, tacky rather weak compound that gives very good adhesion when gripped by the hand. The sides of the grip are oppositely flanged so that an overlapping relation along the edges thereof is obtained when the grip is wrapped in a spiral pattern on a tennis racket handle.

DESCRIPTION OF THE PREFERRED EMBODIMENT

Figure 1:
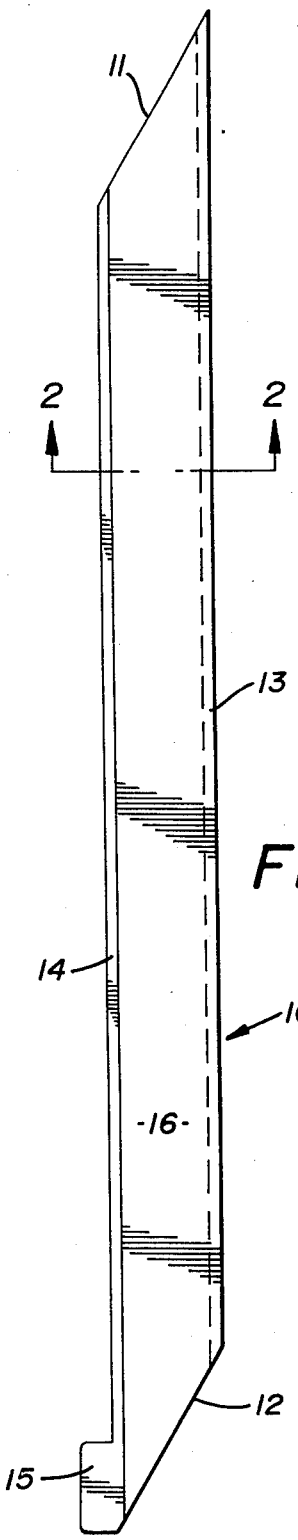
FIG. 1 is a plan view of the rubber grip for tennis racket handles.
Figure 2:
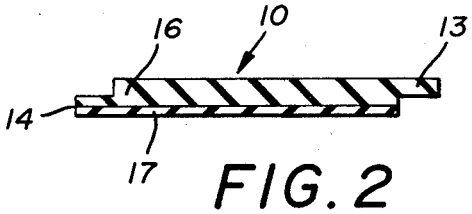
FIG. 2 is an enlarged cross section on line 2—2 of FIG. 1.

By referring to the drawings and FIGS. 1 and 2 in particular, it will be seen that the rubber grip for tennis racket handles comprises an elongated strip 10, the ends of which are diagonally formed as at 11 and 12 respectively, the elongated strip 10 has a longitudinal flange 13 on its upper right hand edge as seen in FIG. 1 of the drawings, an oppositely disposed secondary longitudinally extending flange 14 on its lower left hand edge as seen in FIG. 1 of the drawings. The one end of the secondary longitudinal flange 14, the lower end as seen in FIG. 1 of the drawings, has a sidewardly extending tab 15 formed integrally therewith.

By referring now to FIG. 2 in particular, an enlarged cross sectional detail of the rubber grip for tennis racket handles 10 may be seen to be formed of a lamination wherein an upper or outer relatively thick layer 16 is joined to an inner or lower relatively thinner layer 17. The longitudinal flange 13 will be seen to be formed entirely of the material of the relatively thicker layer 16 and the secondary longitudinal flange 14 will be seen to be formed of a portion of the relatively thick upper layer 16 and a full thickness section of the relatively thin layer 17 of the grip.

The relatively thin layer 17 of the double lamination comprising the grip is a harder, stronger material having characteristics permitting the grip to be stretched and wrapped around the tennis racket handle without fear of breaking or tearing. It is essentially a clay loaded compound of natural rubber. Durometer — 55, Shore $A_2$ hardness. Tensile — 3,000 psi minimum. Ingredients such as pariffin wax, agerite white, steric acid and zinc oxide are added for maximum aging properties.

The relatively thick outer layer 16 is a soft tacky rather wek compound that will provide good adhesion when gripped by the hand holding the tennis racket. It is a natural rubber compound, Durometer —20, Shore A hardness, Tensile —1,200 psi minimum and it incorporates approximately 15% pine tar resin to achieve a tacky surface. Ingredients including butyl HT 1066 and zinc oxide are included to provide maximum aging properties.

Figure 3:
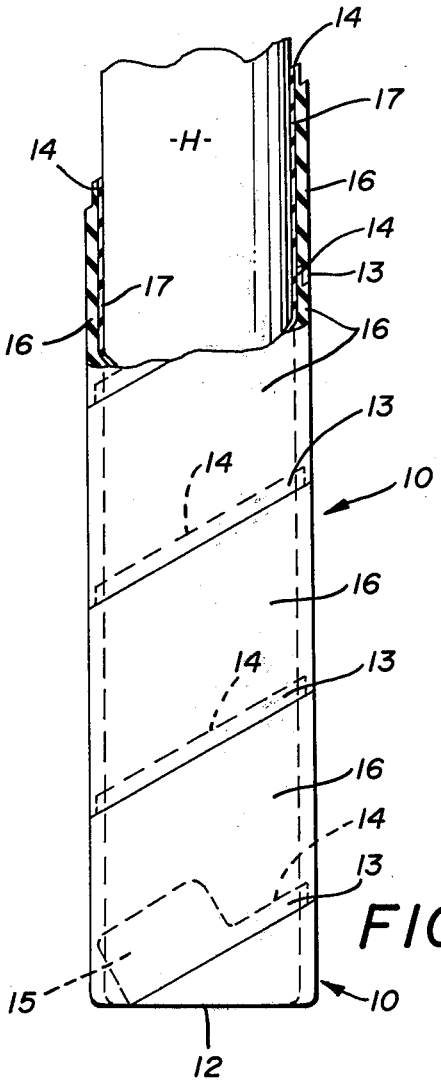
FIG. 3 is a plan view of a portion of a tennis racket handle with the rubber grip of the invention positioned thereon and with parts broken away and in cross section.

The two compounds from which the rubber grip for a tennis racket handle is formed are mixed separately, calendared into separate rolls and wrapped in poly-liners. The materials are then layered together with the plastic liner being exposed on both sides and cut into strips approximately 17 inches by 1 and 1/16 inches, the ends being diagonally cut which is a substantial preformed size. The poly-liner facing is removed and the laminated strips are placed in a mold and compression molded to secure vulcanization at a suitable temperature comprising 325° F. for a time of approximately 10 minutes. The molding and vulcanization of the grip form the integral oppositely disposed longitudinal edge flanges 13 and 14 and the tab 15. The finished product may then be wrapped about a tennis racket handle H as in FIG. 3 starting from the bottom of the handle H with the tab 15 towards the top of the racket and the diagonal end 12 flush with the bottom of the handle H. On the first clockwise wrap the tab 15 is overlapped and holds the grip securely to the racket handle. The wrap is then continued in a spiral pattern with the wrap being stretched approximately two and one-half times and wrapping in a clockwise direction until the top of the handle is reached. The longitudinal flange 13 registers with and overlies the secondary longitudinal flange 14 so that in the finished wrap there is a uniform thickness.

At the upper end of the wrap the diagonal end 11 provides a transverse finished line and rubber tape such as electrical tape having a self-sealing adhesive, is then wrapped around the upper end to finish the application of the rubber grip to the tennis racket handle H.

It will thus be seen that a novel, rubber grip has been disclosed which has a number of superior qualities including less slippage than the leather or plastic grips heretofore commonly used and it is relatively longer wearing. It has considerably greater shock absorbing characteristics than the grips previously used and it provides better hand comfort when held. It does not harden with age and it is easily and quickly installed.

Although but one embodiment of the present invention has been illustrated and described, it will be apparent to those skilled in the art that various changes and modifications may be made therein without departing from the spirit of the invention and having thus described my invention, what I claim is:

1. A rubber grip for a tennis racket handle comprising a single longitudinally stretchable wrapping strip formed of two layers of two different rubber compounds cured and joined by vulcanization, the first compound being relatively harder and stronger than the second compound which is relatively softer, more tacky and weaker than the first compound, the first compound forming a base layer of the wrapping strip when positioned around a tennis racket handle and the second compound forming the outer layer and the surface of the rubber grip on the tennis racket handle, said strip having opposite edges, longitudinally extending flanges formed on said opposite edges of said wrapping strip in oppositely disposed relation to one another, one of said flanges having a surface coextensive the surface of the base layer and the other flange having a surface coextensive with the surface of the outer layer and surface of the rubber grip, a tab formed on and extending perpendicularly from the longitudinal flange having a surface coextensive with said base layer and arranged to be initially overlapped by said wrapping strip when the rubber grip is wrapped around a tennis racket handle so as to form a self-containing end construction.

* * * * *